United States Patent [19]

Boudin et al.

[11] 4,407,584

[45] Oct. 4, 1983

[54] VESSEL LID ESPECIALLY FOR A MIXER USED FOR THE HOMOGENIZATION OF A MIXTURE OF PRODUCTS

[75] Inventors: Daniel Boudin, Orleans; Claude Brachet; Pierre Desmier, both of St. Jean de la Ruelle; Pierre Foltier; Jean Godat, both of Olivet; Alain Krzywdziak, St. Denis en Val; Daniel Parmenon, Orleans la Source, all of France

[73] Assignee: Fonderie et Ateliers des Sablons, France

[21] Appl. No.: 230,109

[22] Filed: Jan. 29, 1981

[30] Foreign Application Priority Data

Feb. 11, 1980 [FR] France ..... 80 02940

[51] Int. Cl.[3] ..... B01F 7/16; B01F 15/00

[52] U.S. Cl. ..... 366/279; 366/349; 366/605

[58] Field of Search ..... 366/197, 297, 605, 289, 366/198, 199, 249–254, 347, 349, 331, 279; 211/74, 71; 220/90, 314; 141/378, 369

[56] References Cited

U.S. PATENT DOCUMENTS

| | | | |
|---|---|---|---|
| 2,445,216 | 7/1948 | Foltz | 366/198 |
| 2,564,979 | 8/1951 | Jorgensen | 220/90 |
| 2,603,461 | 7/1952 | Marienthal | 366/605 X |
| 2,757,910 | 8/1956 | O'Neill | 366/605 X |
| 2,802,649 | 8/1957 | Stockton | 366/197 |
| 2,898,094 | 8/1959 | O'Neill, Jr. | 366/605 X |
| 2,965,363 | 12/1960 | Worden | 366/197 |
| 3,175,808 | 3/1965 | Dedoes | 366/605 X |

*Primary Examiner*—Philip R. Coe
*Assistant Examiner*—Joseph M. Pitko
*Attorney, Agent, or Firm*—Scully, Scott, Murphy & Presser

[57] ABSTRACT

The invention relates to a lid upon which a vessel can be fixed. The lid comprises a pouring spout optionally equipped with a valve device and a handle capable of including control means for said valve device. The lid comprises, moreover, means permitting its mutual fitting upon a support element, a position in which it carries said vessel. The lid according to the invention is especially adapted to be employed in a mixing machine used for the homogenization of a product mixture.

14 Claims, 5 Drawing Figures

VESSEL LID ESPECIALLY FOR A MIXER USED FOR THE HOMOGENIZATION OF A MIXTURE OF PRODUCTS

BACKGROUND OF THE INVENTION

1. Field of the Invention

The present invention relates to a vessel lid especially, but not exclusively, adapted to be used with a mixer for the homogenization of a product mixture of which at least one component is present in the liquid phase.

The invention herein also relates, in the one case, to the mounting of these lids furnished with their vessels upon a support consisting, for example, of a mixing machine of the type used for keeping base paints used in car body plants, in view of the production of colors corresponding to the various vehicles in use, and in the other case, to a coupling device permitting the rotational driving of the mixer mounted upon this lid from the drive system incorporated into the machine.

2. Description of the Prior Art

In a general way, it is known that the mixing machines presently existing on the market all comprise a system of linear or, at times, circular, racks upon which base paint cans are placed, these cans being more or less positioned at the lower part by clips or stops holding the container by the slight protuberance of the base's setting. Furthermore, the rotational driving of the mixer connected to each of these cans is generally assured, by a rapid coupling device, to the machine's drive system and which consists of a fork in U form mounted on the mixer's shaft, which works together with a rotary blade driven by the drive system, the assembly constituting a very imperfect universal joint.

These types of machines present, moreover, several drawbacks principally due to the fact that the distance between the coupling device connected to the machine and the quiet surface of the container depends on several factors such as the container's height or the precision of the racks' construction. Furthermore, fastening by clips is more or less effective according to the condition of the clips and the diameter of the containers, which causes at times inadvertent slips of the containers upon their support, consequently mistakes of alignment of the mixer's shaft and the machine's drive mechanism, and at times even the ejection of the container and its lid.

SUMMARY OF THE INVENTION

In view of eliminating these drawbacks, the invention proposes to no longer use the container as a lid support, but on the contrary, to use the lid as a container support. Such an arrangement therefore makes it possible to use containers of variable dimensions in the machine without modifying the respective position of the two component parts of the coupling mechanism.

To obtain this result, the lid and mixing machine according to the invention are equipped with mutually reciprocal gearing devices and means allowing a relatively precise positioning of the lid with respect to the drive mechanism of the machine.

To achieve this purpose, the lid can include two parallel slides, for example, of a trapezoidal cross-section, fitting in two tracks of complimentary cross-section integral with the mixing machine and a suitably located stop making it possible to position the mixer's coupling unit in relation to the machine's.

It will be noted that the mixer's rotational driving can be obtained by means of the previously described device which involves a fork-blade coupling.

However, according to one advantageous embodiment of the invention, this driving can be obtained by an endless chain mounted upon pinions integral with the machine and of which one, at least, is driving. In this case, the mixer's shaft is provided with a pinion whose teeth mesh, when the lid comes to bear upon said stop, in the links of said chain.

A safety device, such as a circuit load-breaking device, can additionally be provided to permit a slipping of the drive device, or its disengagement, in case of abnormal stress, for example, when the container is bumped into and locks the mixer, or when the latter is held back by a particularly hard layer of deposit on the bottom of the container.

BRIEF DESCRIPTION OF THE DRAWINGS

One embodiment of the invention will be described hereafter, as a non-limiting example, with reference to the attached drawings in which.

DESCRIPTION OF THE PREFERRED EMBODIMENTS

Figure 1:
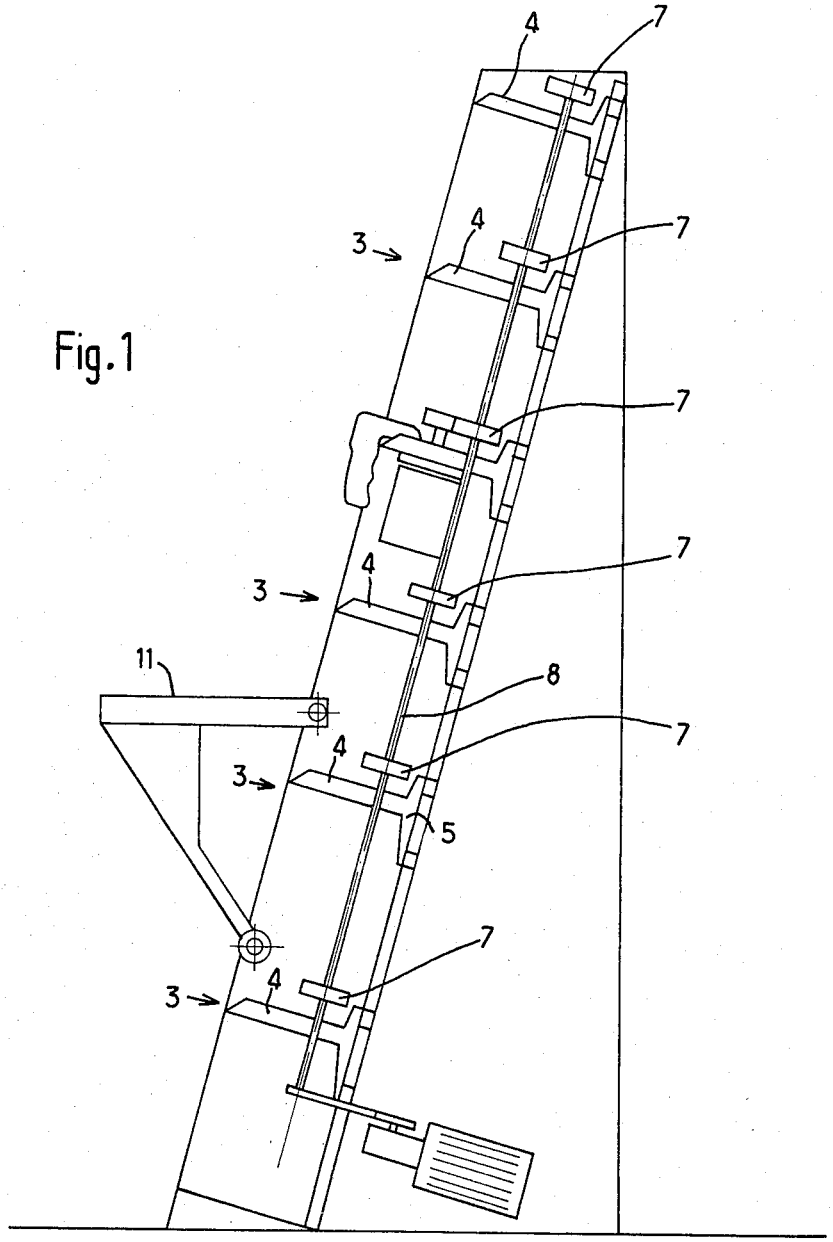
FIG. 1 is a schematic vertical section of a mixing machine.
Figure 2:
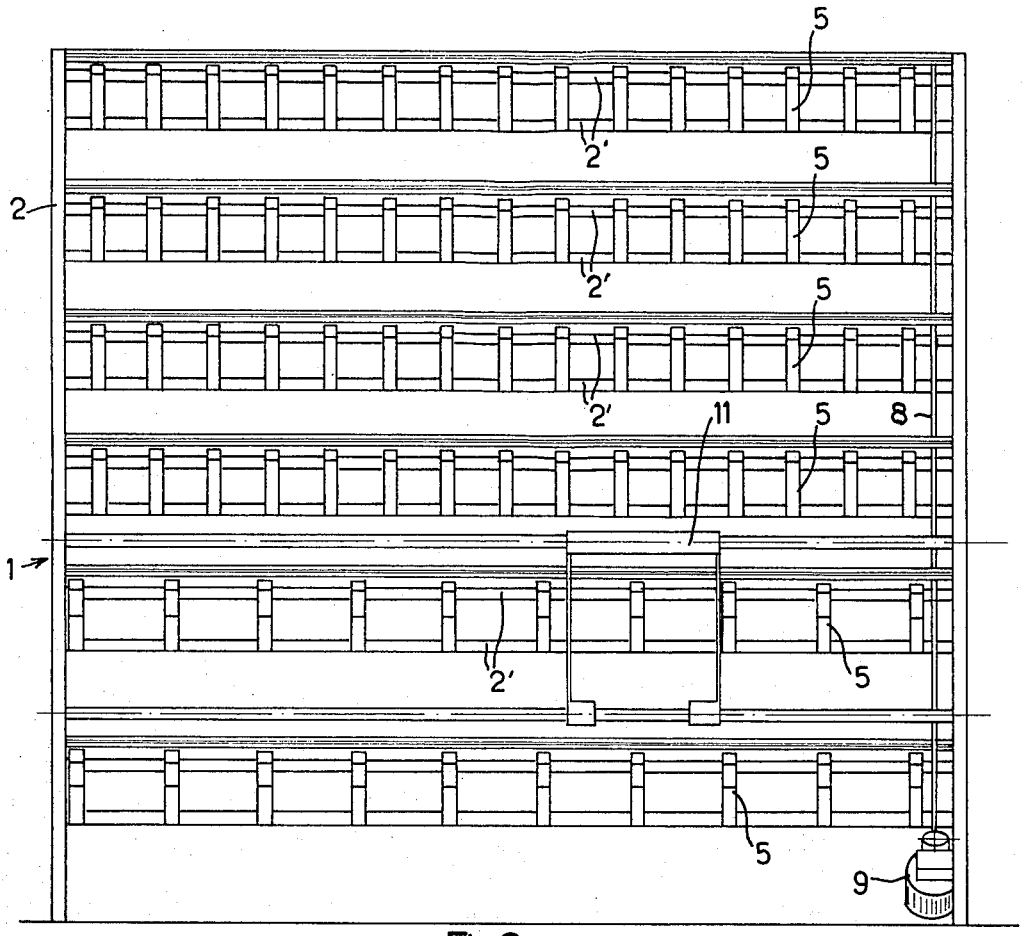
FIG. 2 is a front view of the machine represented in FIG. 1.
Figure 3:
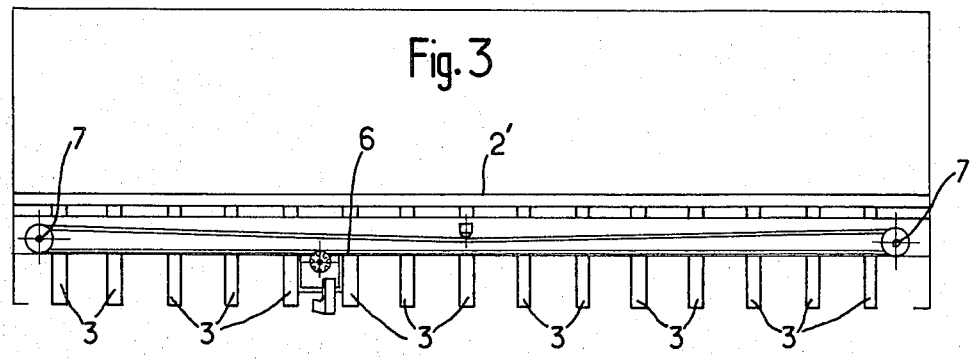
FIG. 3 is a partial schematic horizontal section of the machine shown in FIGS. 1 and 2.
Figure 5:
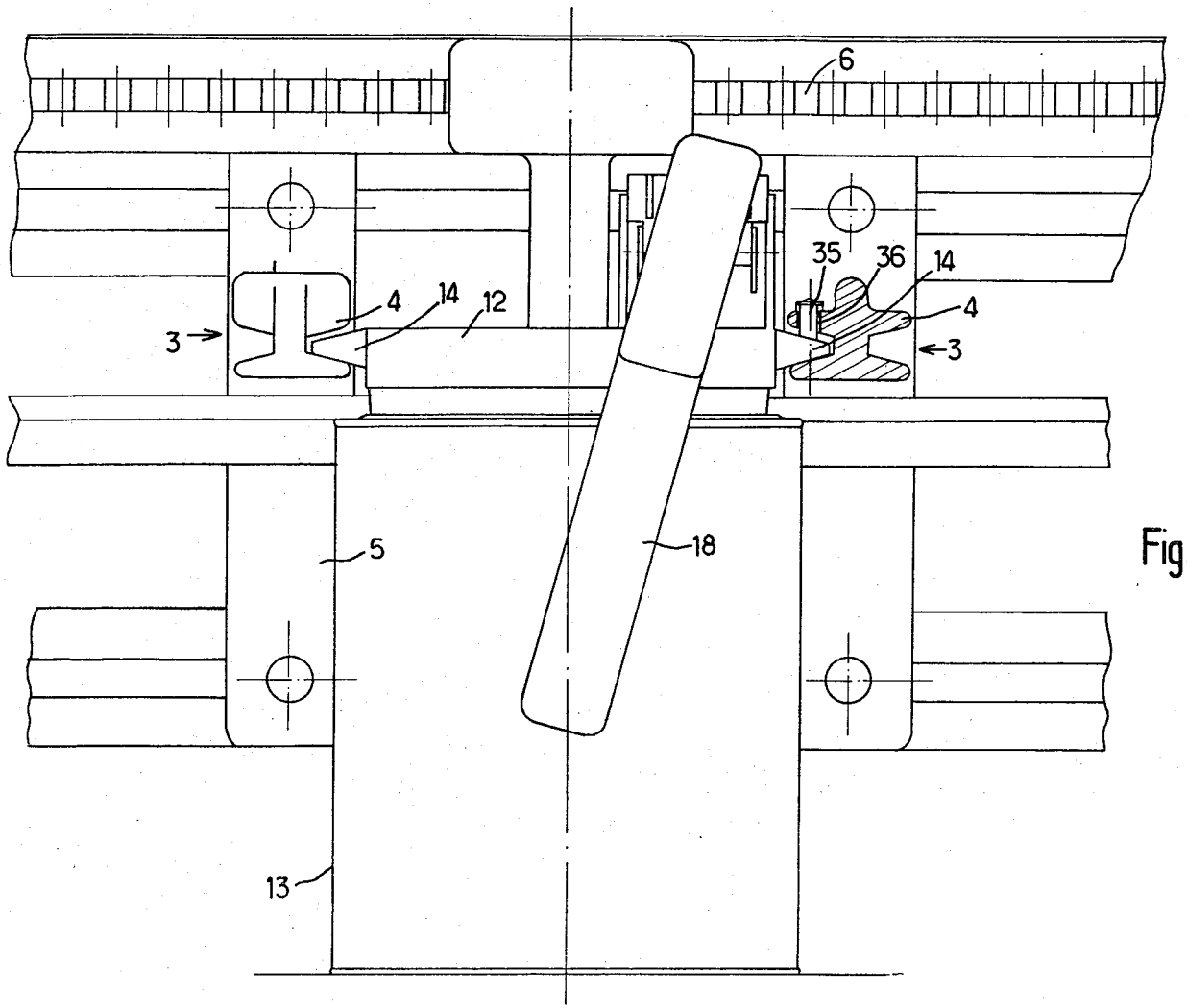

Referring to FIGS. 1 to 3, the mixing machine is illustrated in the form of a metallic structure 1 composed of a rectangular frame 2 and a variable number of horizontal cross-bars 2 supporting slides 3 perpendicular to frame 2. These slides 3 can consist, as shown in FIG. 5, of sections 4 with a profile in the form of an H, integral, at one end, with a support piece 5 capable of being screwed upon said cross-bars 2'

Positioned above each of slides 3, and at a fixed height therefrom, is mounted a horizontal endless chain 6 meshing with two lateral pinions 7 (FIG. 3) with vertical shafts, of which one is driven by a vertical transmission rod 8 connected at its lower end to self-contained drive group 9 which makes it possible to drive the assembly of mixers, for example, by an electric motor or even by a pneumatic motor.

This endless chain 6 can be protected by a casing 10 consisting of a horizontal section in the shape of a U or C, fixed on its vertical side to said frame 2.

Structure 1 can, in addition, include in its lower end, a table provided with a workstop 11 moving laterally upon sliding rollers, in such a way that in moving this workstop, access can be had it all of the containers maintained upon structure 1.

As previously stated, each of the pairs of slides 4 receives suitable lid 12 which is solidly fixed upon base paint container 13 and upon which a mixer is mounted.

For this purpose, lid 12 comprises two lateral trapezoidal wings 14 located at a distance such that they can engage the sides of the H forming slides 4, said H being widened (widening 4', FIG. 4) at the front end so as to facilitate the engagement of lid 12 and avoid its being able to rest between the wings of the H upon too short a length as the latter would risk bringing about the breaking of the wings due to the overhang.

Figure 4:
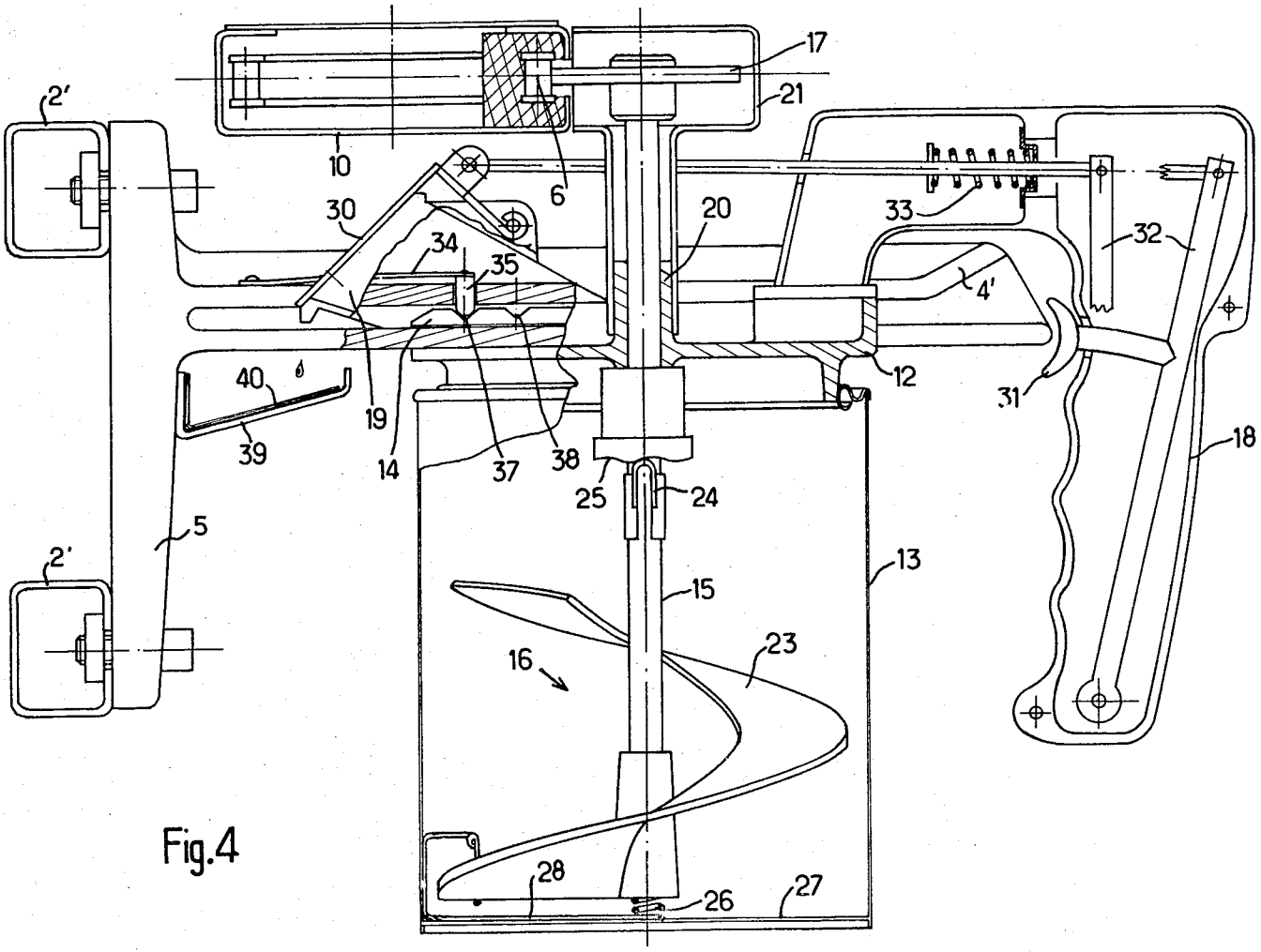
FIG. 4 is a vertical section on a larger scale of a lid furnished with its container mounted in the mixing machine; and, FIG. 5 is a rear view of a lid furnished with its container fitted in the mixing machine.

As previously stated, in this lid 12 is rotatably mounted drive-shaft 15 (FIG. 4) with a mixer 16 which comprises, at its upper end, a driving-pinion 17 meshing upon chain 6 when lid 12 is in the end position upon slides 4 (FIGS. 4 and 5).

It is to be noted that, taking into account the diameter of containers 13, slides 4 can be adjustable in the distance which separates them. Likewise, it is possible, taking into consideration the height of containers 13, to provide a height adjustment of the rows of slides 4 as well as endless chains 6 which are connected to them.

It is further within the scope of this invention to provide supplementary rows of slides 4 capable of practically reaching floor level thereby resulting in very considerable savings on the space occupied by the machine without at the same time causing upper rows to be inaccessible to persons of diminutive height as may occasionally be the case.

To facilitate the putting back and pulling out of containers 13, lid 12 can include an operating handle 18. In the case where pouring spout 19 is not positioned in the shaft of lid 12, which is preferable because the useful surface of pouring spout 19 can be increased, handle 18 is represented slightly inclined so that, in pouring position, there will not be any rocking couple supported by the operator's handle. It is evident that if pouring spout 19 were placed in the lid's shaft the handle would be in a vertical position.

Another advantage of this handle 18 lies in the fact that it is possible to reduce the distance between the shafts of containers 13, the operator no longer having to take the container in his hands.

Moreover, handle 18 being sufficiently disengaged from container 13, the drawback of touching these containers 13 which generally include trails of paint is avoided.

Furthermore, this handle 18 can be used to control the valve device opening which can be either a pull-handle, a clapper, or a combination of these two systems.

In the embodiment shown in FIG. 4, mixer-lid 12 comprises a coaxial shaft-bearing member 20 through which shaft 15 of mixer 16 rotates. This shaft-bearing 20 is extended in its upper end by a casing 21, open on one of its lateral sides 22, in which is housed driving-pinion 17 of drive-shaft 15. At the lower end of shaft 15 is fixed a helical ramp 23 whose pitch has been experimentally determined in order to produce the most effective mixing possible without introducing any air during mixing.

In addition to its rotational motion, this ramp 23 is driven by an axial oscillatory motion which is obtained by a device comprising two stops 24 carried by the shaft and which are held in contact by a notched crown 25 of sinusoidal form, integral with lid 12, by a compression spring 26 set between the lower end of the shaft and the bottom 27 of box 13. By its extended part 28, this spring also serves as a scraper for bottom 27 and the lateral surface of container 13.

Lid 12 also comprises pouring spout 19 which is eccentric in relation to the lid and which is closed by a right angle rocking clapper 30. It comprises, moreover, on the side opposite the spout, handle 18 equipped with a trigger 31 which assures the control of clapper 30 owing to a system of small rods 32 with spring return 33.

As previously indicated, lid 12 provided with its container 13 fits within a pair of slides 4 due to its lateral wings 14 until, at stroke end, pinion 17 comes to mesh with chain 6.

To hold this coupling as represented in FIG. 4, small flexible tongues 34 can be provided which are respectively fixed on slides 3 near support elements 5.

These small tongues 34 bear at their free end a center-point 35 passing through holes 36 formed in the upper wings of slides 3 and cooperate with notches made upon the upper face of lateral wings 14 of lid 12.

In the example shown, lateral wings 14 of lid 12 comprise two notches 37 and 38 capable of being used when the diameter of pinions 17 is modified in view of a change in the rotational speed of mixer 16.

In practice, it is easy to modify the rotational speed of mixers 16 merely by choosing an appropriate diameter of driving-pinion 7 of chain 6. A larger pinion 7 for small containers can therefore, for example, be used in order to keep the circumferential speed of mixers 16 constant.

The elasticity of small tongues 34 is determined in such a way that in case of abnormal overload, pinion 17 will have a tendency to unmesh and small tongue 34, which holds lid 12 in position, will act as a couple limiting device.

In the previously described embodiments, especially in respect to FIG. 1, the assembly of slightly inclined lids 12 is shown which facilitates gripping for the operator and which increases the stability of the apparatus without increasing widthwise the floor space occupied by the device. A component of weight is therefore introduced, lid plus container, maintaining pinion 17 in contact with chain 6, the pressure being all the more considerable to the extent the container is full. This component is added to the limiting couple effect obtained by previously described small tongues 34.

In addition, such an inclined position frees an appreciable amount of space at the rear of the structure, which space can advantageously be occupied by the control group and associated electrical equipment.

It will be noted that this installation can be provided for automatic operation of the mixing machine.

For this purpose, a programmed timing device controls the start-up of mixing at determined periods, for example, every four or six hours, and for a determined period, for example, 15 to 20 minutes, these frequencies and these durations having been experimentally determined in operation as a function of the decanting speed of certain paints.

Preferably the programmed timing device has at its disposal a reserve mechanism in case of electrical power interruption. It is evident that this power is produced by a protected power-supply system so that the apparatus functions even at night and during the shops' closed periods.

Moreover, an automatic time-switch permits a manual starting for the duration desired and outside periods of normal mixing, the latter in the case where a container not yet mixed is introduced during the work period.

Safety devices can moreover be provided, and particularly a key switch to avoid inadvertent starting, for example, during maintenance of the machine.

It will finally be noted that the mixing machine can comprise, under pouring spout 19 of the lids, a sectional drain 39 in which an element easy to replace 40 (cardboard, etc.) is placed and that is periodically changed when it is filled with dry paint.

What is claimed is:

1. A lid which is to be attached to a vessel, said lid comprising:

a. a pouring spout;

b. a handle to allow the lid and attached vessel to be carried;

c. a support housing having two slides; and d. means facilitating a fitting to said support housing designed to support the lid and an attached vessel, said means including two lateral support elements on opposite sides of the lid which fit said two slides on the support housing, said slides having a configuration complementary to that of the support elements, and means for adjusting said slides to enable the fitting therein of lids of various sizes.

2. A lid according to claim 1, in combination with said support housing, wherein said slides have a sectional shape substantially in the form of an H, and said lateral support element have a trapezoidal configuration.

3. A lid as claimed in claim 2, said H shaped slides being wided at their open front ends to facilitate the introduction therein of a lid.

4. A lid according to claim 1, in combination with said support housing, said lid rotatably mounting a mixer shaft which is driven in rotation by a driving device connected to the support housing through a coupling device, and including means for defining a stop to allow a relatively precise positioning of the lid in relation to said driving device.

5. An arrangement according to claim 4, wherein said driving device comprises an endless chain carried by at least two rotatably mounted pinions on said support housing, one of which is a driving pinion, and said mixer shaft being provided with a pinion whose teeth mesh with the links of said chain when the lid is fitted in the support housing.

6. An arrangement according to claim 4, wherein said lid includes a shaft bearing through which the shaft of the mixer rotates, and a casing, at the upper end of the mixer shaft, having one open lateral side, and a driving pinion for said mixer shaft being housed in said casing.

7. An arrangement according to claim 4, including a helical mixer element at the lower end of said mixer which, in addition to a rotational motion, is driven with an axial oscillatory motion by two stops carried by said shaft and positioned in contact with a notched cam integral with the lid by a compression spring positioned between the lower end of said mixer shaft and the vessel bottom.

8. The arrangement according to claim 7 in which the last coil of said spring has an extended part which scrapes the bottom and lateral sides of said vessel.

9. A lid according to claim 1, including means for providing a mounting of said lid to the support housing including small flexible tongues mounted on the slides which bear at their free end against notches formed in the upper face of said lateral support elements of the lid, and in case of an abnormal overload, the small tongue which holds the lid in position will act as a limiting coupling as a result of its elasticity.

10. A lid according to claim 1, in combination with a mixing machine for the homogenization and storage of base paints used for car bodies, comprising a metallic housing having a frame and horizontal cross-bars supporting said slides perpendicular to the cross-bars, and also supporting, above said slides, at least one endless chain meshing with at least two vertically-shafted, lateral pinions, one of which is driven by a vertical drive bar connected, at its lower end, to a self-contained drive means powered by a motor, each pair of slides being designed to receive the lid of claim 12.

11. An arrangement according to claim 10, wherein said endless chains are protected by housings, the vertical sides of said housing are attached to said frame.

12. An arrangement according to claim 10, wherein said metallic housing includes a table provided with a worktop movable laterally upon said slides.

13. An arrangement according to claim 10, wherein said slides are slightly inclined in relation to the horizontal such that the weight of the lid and the container maintains a drive pinion for the lid in contact with said chain.

14. A lid as claimed in claim 1, further including a valve coupled to said pouring spout and a control mechanism for said valve mounted on said handle.

* * * * *

UNITED STATES PATENT AND TRADEMARK OFFICE

CERTIFICATE OF CORRECTION

PATENT NO. : 4,407,584

DATED : October 4, 1983

INVENTOR(S) : Daniel Boudin et al.

It is certified that error appears in the above-identified patent and that said Letters Patent is hereby corrected as shown below:

Column 2, line 42, "2" should read -- 2' --.

Column 2, line 61, "it" should read -- to --.

Column 5, line 22, "element" should read -- elements --.
Column 6, line 30, "claim 12" should read -- claim 1 --.

Column 6, line 33, "housing" should read -- housings --.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*